US006752587B2

(12) United States Patent
Lin et al.

(10) Patent No.: US 6,752,587 B2
(45) Date of Patent: Jun. 22, 2004

(54) MODULAR FAN ASSEMBLY

(75) Inventors: Shu-Ju Lin, Taipei (TW); Yih-Wei Tzeng, Taipei (TW)

(73) Assignee: Inventec Corporation, Taipei (TW)

( * ) Notice: Subject to any disclaimer, the term of this patent is extended or adjusted under 35 U.S.C. 154(b) by 107 days.

(21) Appl. No.: 10/212,722

(22) Filed: Aug. 7, 2002

(65) Prior Publication Data

US 2004/0028522 A1 Feb. 12, 2004

(51) Int. Cl.[7] ..... F04D 29/52
(52) U.S. Cl. ..... 415/66; 415/220
(58) Field of Search ..... 415/60, 66, 68, 415/220; 416/120

(56) References Cited

U.S. PATENT DOCUMENTS 2,108,738 A * 2/1938 Allen ..... 415/60
2,729,389 A * 1/1956 Koch ..... 415/60
4,988,930 A * 1/1991 Oberheide ..... 318/82
6,491,502 B2 * 12/2002 Hunt ..... 415/220

FOREIGN PATENT DOCUMENTS

JP 05172094 A * 7/1993 ..... F04D/25/16

* cited by examiner

*Primary Examiner*—Edward K. Look
*Assistant Examiner*—Richard Edgar
(74) *Attorney, Agent, or Firm*—Bacon & Thomas, PLLC.

(57) ABSTRACT

The present invention is to provide a modular fan assembly mounted in an electronic device comprising a frame having a defined opening for air circulation; at least two spaced apart fans disposed within the frame, each fan having a stator and a plurality of blades attached to the stator; and a divider disposed between the fans for partial separation wherein an outer end of the divider is smaller than a depth of the frame, thereby leaving a distance between the outer end of the divider and an outer surface of the frame so that an area of the opening for an escape of air from the fans is increased for effectively reducing a resistance of air flow and obtaining a maximum draft by means of the divider.

3 Claims, 5 Drawing Sheets

MODULAR FAN ASSEMBLY

FIELD OF THE INVENTION

The present invention relates to fans mounted in an electronic device and more particularly to an improved modular fan assembly mounted in a server.

BACKGROUND OF THE INVENTION

Applications of fans have been extended to more fields as a result of rapid, spectacular development of electronics, telecommunications, and network technologies. Also, features and sizes of the fans have become more powerful and compact respectively for complying with the requirements of various electronic and telecommunication products. For example, an industrial server has a design height of IU (note that an IU equal to 44.45 mm). It is known that a central processing unit (CPU) and other electronic components of the server operate in a faster duty cycle may generate more heat. Hence, at least one fan is required to cool the CPU and the components for lowering temperature of the server below a maximum operating temperature. As an end, the server may operate normally.

Typically, a fan mounted in the server has a size of 40 mm×40 mm×20 mm. Such fan has a higher heat dissipation efficiency than other smaller sized fans such as ones having a size of 30 mm×30 mm×10 mm or 25 mm×25 mm×10 mm. It is also known that the smaller of fan the higher of difficulty and cost in manufacturing. As such, in many cases a fan having a size of 40 mm×40 mm×20 mm is now installed in a narrow interior space of the server after considering factors of cost, heat dissipation efficiency, and construction.

A typical fan assembly 3 provided in the server 2 is shown in FIG. 1. The fan assembly 3 comprises a plurality of parallelepiped fans (three are shown) which are spaced apart at a side of the server 2. Screws are driven through four corners of frame 31 of each fan to secure to a case of the server 2. In operation, the fan assembly 3 can set up a current of air for driving out high heat generated within the server 2 as well as bring fresh cool air into the server 2. As a result, temperature of the server 2 is lowered below a maximum operating temperature by such cooling so as to maintain a normal operation of the server 2.

However, the prior art suffered from several disadvantages. For example, an opening for the escape of hot air is limited in size due to construction of the case of the server 2. Hence, air circulation is poor, resulting in a decrease of a maximum draft. Further, the threaded securing of the fan assembly 3 including the plurality of spaced apart fans to the server 2 is labor and time consuming and non-space saving in view of the narrow interior space of the server 2. Furthermore, the latter contradicts the trend of compact, slim design of modern electronic products. Hence, a heat dissipation efficiency of the fan having a size of 40 mm×40 mm×20 mm is not satisfactorily high in a practical use due to construction of the fan frame and arrangement of the fan. Thus improvement exists.

SUMMARY OF THE INVENTION

A primary object of the present invention is to provide a modular fan assembly mounted in an electronic device. The fan assembly mounted in an electronic device comprises a frame having a defined opening for air circulation; at least two spaced apart fans disposed within the frame, each fan having a stator and a plurality of blades attached to the stator; and a divider disposed between the fans for partial separation wherein an outer end of the divider is smaller than a depth of the frame, thereby leaving a distance between the outer end of the divider and an outer surface of the frame so that an area of the opening for an escape of air from the fans is increased for effectively reducing a resistance of air flow and obtaining a maximum draft by means of the divider.

In one aspect of the present invention, there is further provided an identical second modular fan assembly formed tandem with the modular fan assembly.

In another aspect of the present invention, there is further provided at least two sets of a plurality of vanes attached to the stator of each fan, each set of the vanes being disposed between the tandem fans wherein an orientation of a curved surface of each vane is opposite to that of the blade of each fan in the frame. When the blades of the fans are rotating toward the divider, air is parallel sucked into the opening by passing through the fans for bringing air to the vanes for guiding into and causing the blades of the fans of the second fan assembly to rotate oppositely, thereby obtaining a maximum draft.

The above and other objects, features and advantages of the present invention will become apparent from the following detailed description taken with the accompanying drawings.

DETAILED DESCRIPTION OF THE PREFERRED EMBODIMENTS

The invention is directed to a modular fan assembly for overcoming the above drawbacks of the prior art which is characterized in that a plurality of spaced apart fans are threadedly secured to a side of a server for driving out high heat generated by electronic components of the server during operation. However the well known fan assembly has the drawbacks of poor draft, non-space saving, being limited by the narrow interior space of the server due to the construction of the fan frame.

Figure 1:
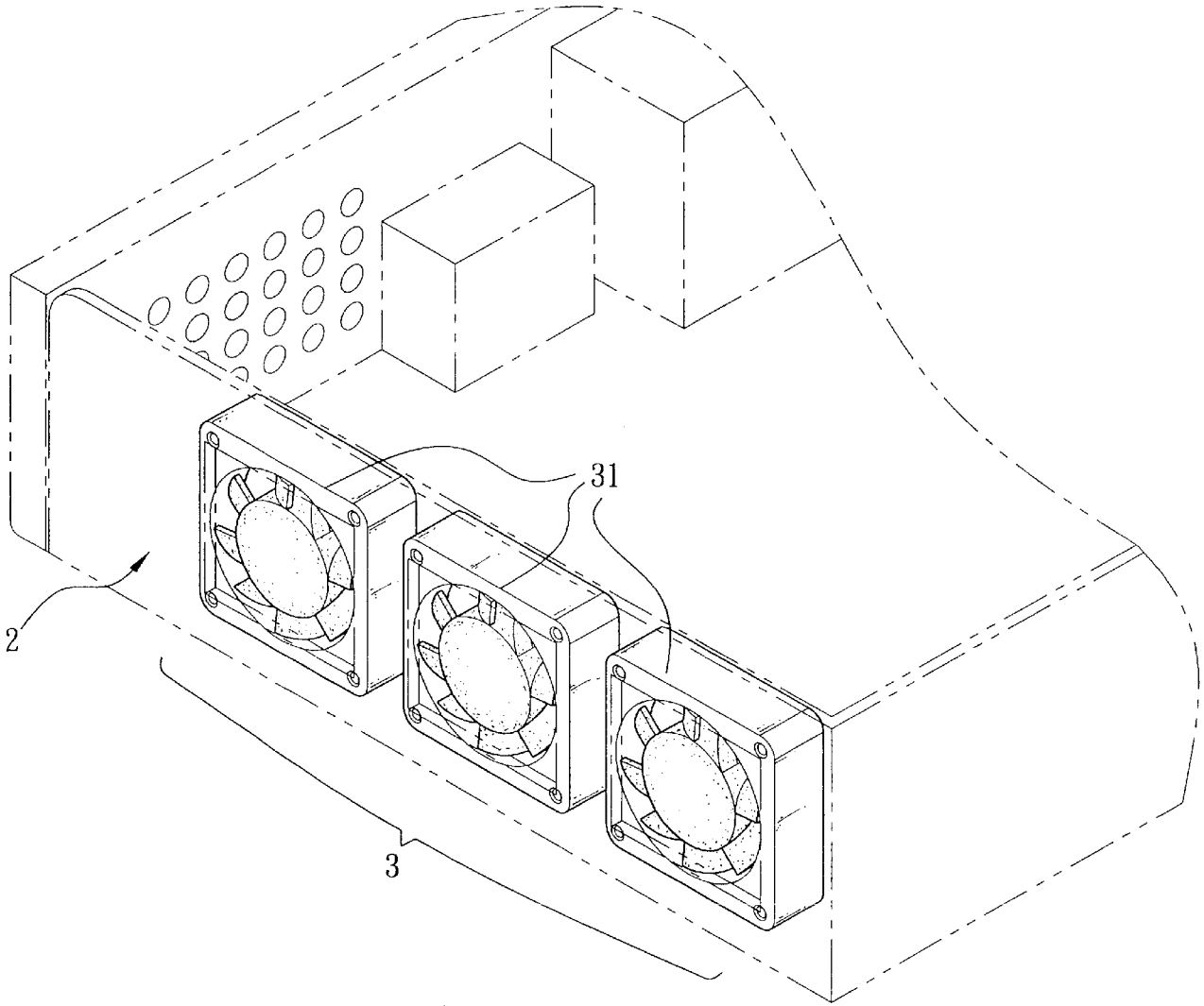
FIG. 1(Prior Art)
FIG. 1 is a perspective view of a conventional fan assembly mounted in a server.
Figure 2:
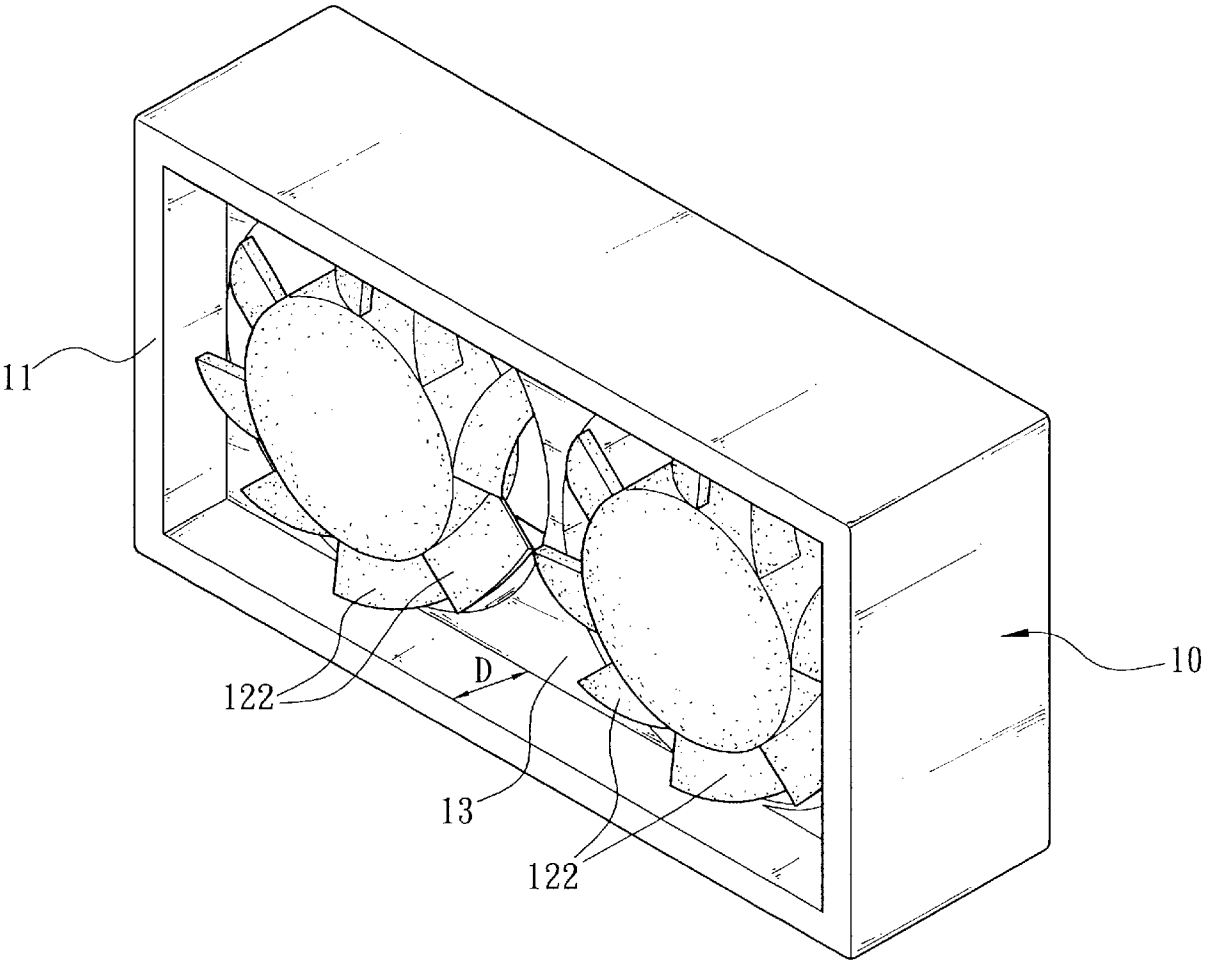
FIG. 2 is a perspective view of a first preferred embodiment of a modular fan assembly according to the invention.
Figure 3:
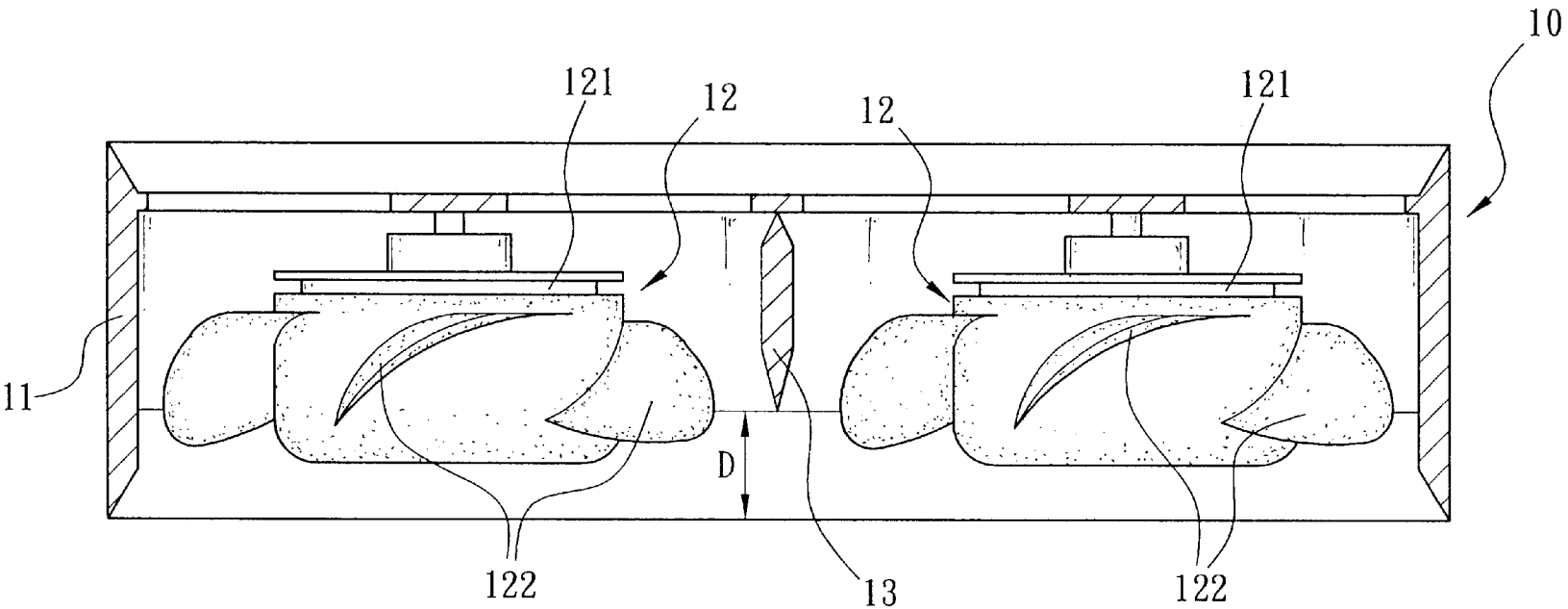
FIG. 3 is a top plan view in part section of the fan assembly shown in FIG. 2.

Referring to FIGS. 2 and 3, there is shown a modular fan assembly 10 in accordance with the invention comprising a rectangular frame 11 and at least two spaced apart fans 12 disposed lengthwise within the frame 11. Each fan 12 has a stator 121 and a plurality of blades 122 attached to the stator 121. Note that components, other than the stator 121 and the blades 122 related to the disclosure of the invention, are well known. Thus a detailed description thereof is omitted herein for the sake of brevity. A front opening for air circulation is defined by the frame 11. A divider 13 is disposed between the fans 12 for partial separation. An outer end of the divider 13 is smaller than a depth of the frame 11, thus leaving a distance D between the outer end of the divider 13 and an outer surface of the fan assembly 10. Preferably, the distance D is designed to render a smallest pressure drop of air circulating in the fan assembly 3, i.e., at a critical point. With such internal divider 13, an area of the opening for the escape of air from the fans 12 is increased for effectively reducing a resistance of air flow.

For a characteristic curve (e.g., P-Q curve) of fan, a system having a smaller air pressure drop can effect a higher draft. As such, a resistance of air flow is reduced and accordingly a maximum draft is obtained due to an increase of the area of the opening for the escape of air when the blades 122 of both fans 12 are rotating toward the divider 13. In a case that the fan assembly 10 is provided within a case (not shown) of a server temperatures of CPU and other components (not shown) in the server can be greatly reduced during operation, resulting in a desirable cooling of the server. Moreover, by configuring two fans 12 in an interior space defined by the frame 11 of the fan assembly 10 two adjacent sides of the conventional frames 31 can be eliminated, resulting in a further reduction of size of the fan assembly 10.

Figure 4:
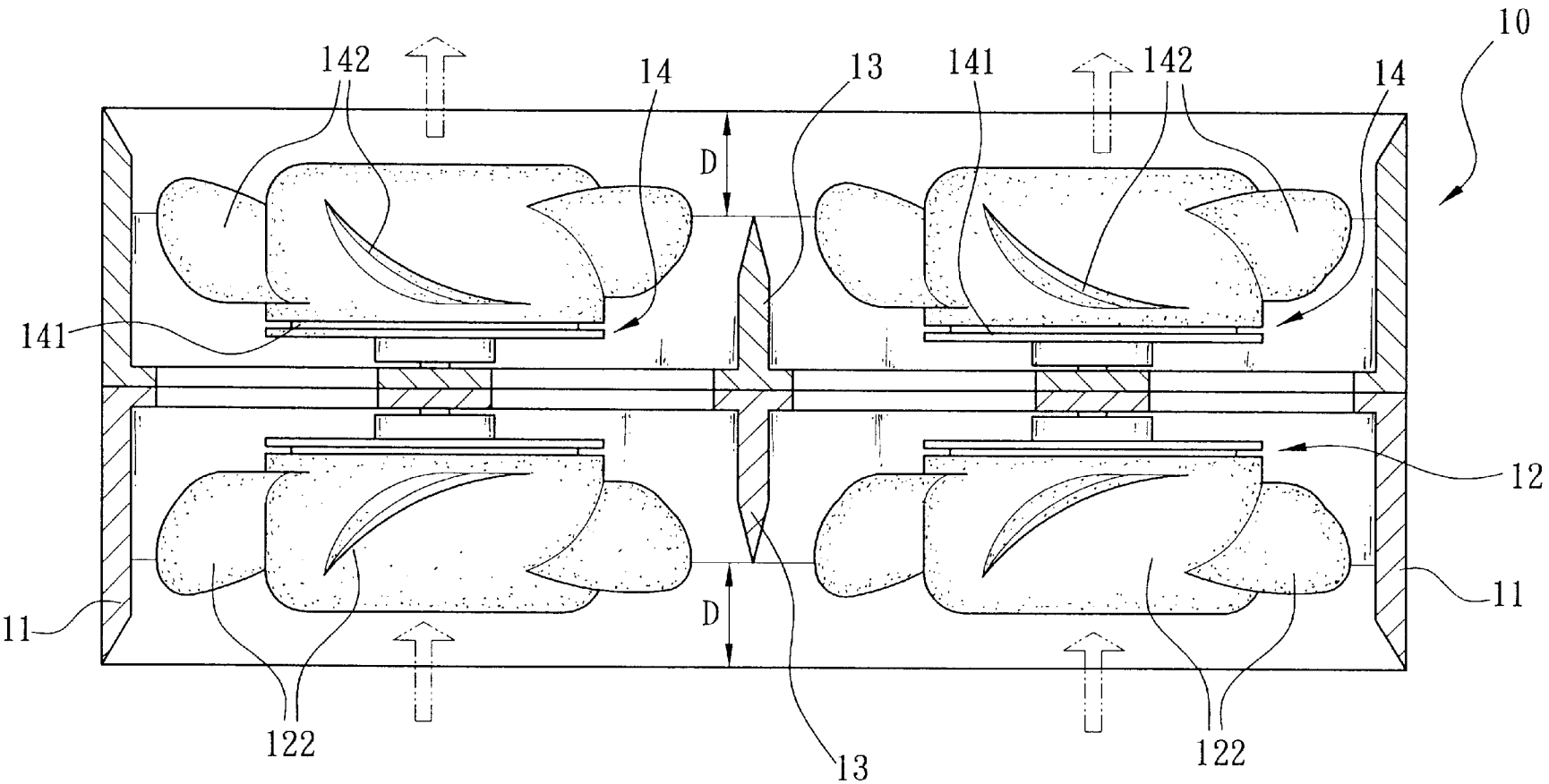
FIG. 4 is a top plan view in part section of a second preferred embodiment of a modular fan assembly according to the invention.

Referring to FIG. 4, there is shown a second preferred embodiment of a modular fan assembly 10 according to the invention. This embodiment is substantially comprised of two coupled fan assemblies 10 of the first embodiment. In detail, the fan assembly 10 comprises two tandem rectangular frames 11 formed together and two pairs of fans 12, 14 wherein either fan 12 of one pair and a corresponding fan 14 of the other pair are disposed on the same rotary shaft, i.e., a stator 141 of the fan 14 aligned with the stator of the fan 12 on the rotary shaft. The spaced apart fans 14 are disposed lengthwise within a second frame 11. Each fan 14 has a stator 141 and a plurality of blades 142 attached to the stator 141. A second (i.e., rear) opening for air circulation is defined by the second frame 11. A second divider 13 is disposed between the fans 14 for partial separation. An outer end of the second divider 13 is smaller than a depth of the second frame 11, thus leaving a distance D between the outer end of the second divider 13 and the opposite outer surface of the fan assembly 10. In operation, air is sucked into the front opening prior to leaving the second opening by passing through two parallel sets of the fans 12 and 14. As a result, a maximum draft is obtained for effectively cooling the server.

Figure 5:
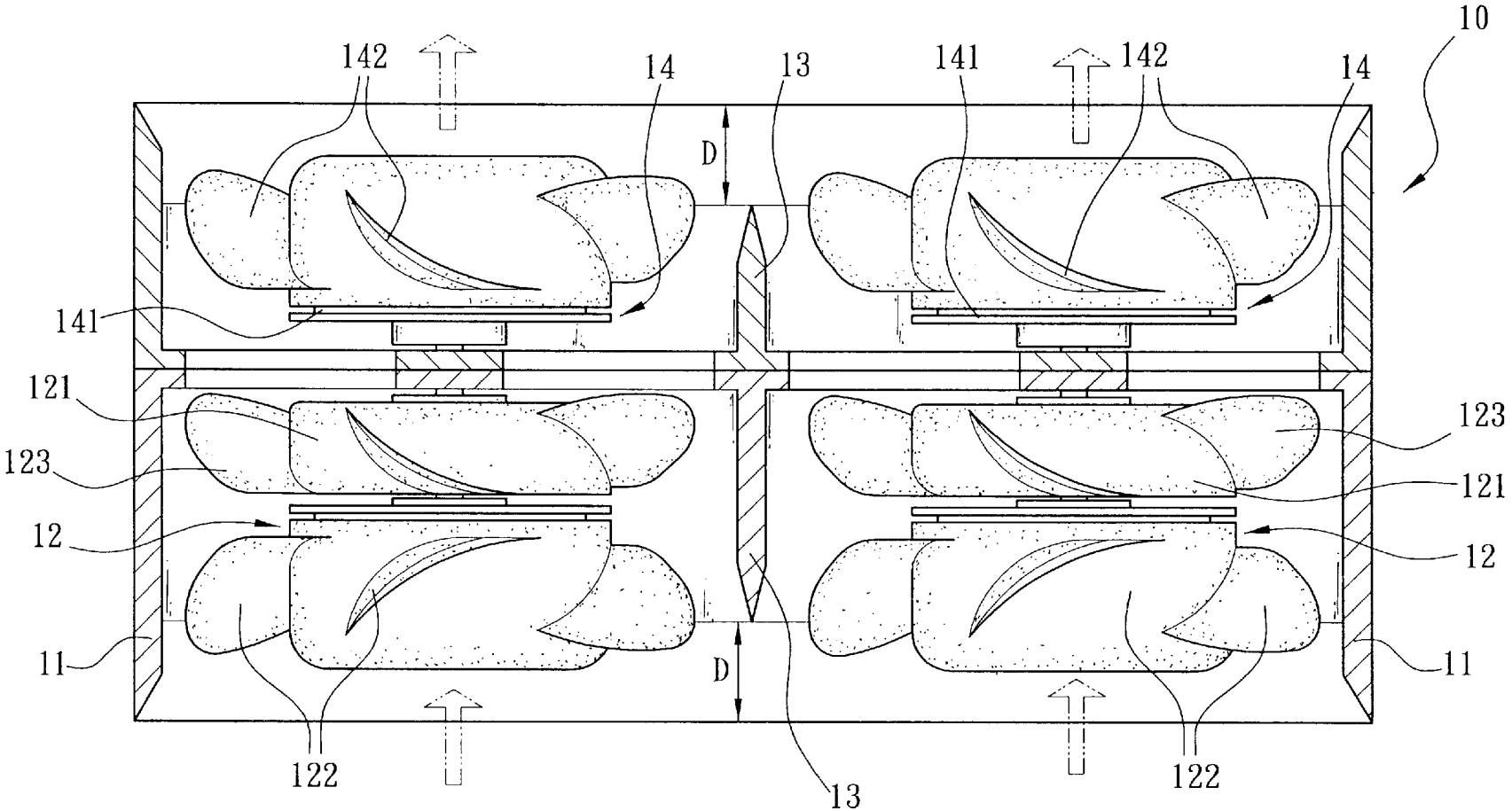
FIG. 5 is a top plan view in part section of a third preferred embodiment of a modular fan assembly according to the invention.

Referring to FIG. 5, there is shown a third preferred embodiment of a modular fan assembly 10 according to the invention. This embodiment is substantially the same as the second embodiment except the following as detailed below. A plurality of vanes 123 are attached to the stator 121 of either fan 12. That is, the vanes 123, the blades 122, and the blades 142 are disposed from the front to the rear and aligned on the rotary shaft. Orientation of the curved surface of the vane 123 is opposite to that of the blade 122 of the fan 12. In operation, air is sucked into the front opening prior to leaving the second opening by passing through two parallel sets of the fans 12 and 14 wherein in each set of the fans 12 and 14 the brought in fresh air is first set up by the blades 122 to form a current of air which is in turn guided by the vanes 123 prior to passing through the blades 142 of the fan 14. Alternatively, in another configuration of the third embodiment the vanes 123 are attached to the stator 141 of either fan 14. Also, the orientation of the curved surface of the vane 123 is opposite to that of the blade 142 of the fan 14. As shown, the vanes 123 are formed on an outer surface of the stator 121 of either front fan 12 while details of another configuration of the third embodiment (i.e., the vanes 123 are formed on an outer surface of the stator 141 of either rear fan 14) are not illustrated in the drawing. This is because it is only a simple alternation which can be readily understood by those skilled in the art.

In operation of the third embodiment, a resistance of air flow is reduced and accordingly a maximum draft is obtained due to an increase of the area of the opening for the escape of air from the fans 12 when the blades 122 of the fans 12 are rotating toward the divider 13. Further, air is sucked into the front opening prior to leaving the second opening prior to leaving the second opening by passing through two parallel sets of the fans 12 and 14 wherein in each set of the fans 12 and 14 the current of air set up by the blades 122 is guided by the vanes 123 and in turn a positive pressure is generated by the guided air to cause the blades 142 of the fan 14 to rotate in a direction opposite to that of the blades 122 of the fan 12. As a result, a maximum draft is also obtained for effectively cooling the server.

While the invention has been described by means of specific embodiments, numerous modifications and variations could be made thereto by those skilled in the art without departing from the scope and spirit of the invention set forth in the claims.

What is claimed is:

1. A modular fan assembly mounted in an electronic device, comprising:

a first frame having a defined opening for air circulation;

at least two spaced apart first fans disposed within the first frame, each first fan having a stator and a plurality of blades attached to the stator;

a divider disposed between the first fans for partial separation wherein an outer end of the divider is smaller than a depth of the first frame, thereby leaving a first distance between the outer end of the divider and an outer surface of the first frame so that an area of the opening for an escape of air from the first fans is increased; and further comprising a second frame formed tandem with the first frame, the second frame having a defined opposite opening for air circulation;

at least two spaced apart second fans disposed within the second frame, each second fan being coaxial with the corresponding first fan and having a stator and a plurality of blades attached to the stator thereof;

a second divider disposed between the second fans for partial separation wherein an outer end of the second divider is smaller than a depth of the second frame, thereby leaving a second distance between the outer end of the second divider and an outer surface of the second frame; and further comprising at least two sets of a plurality of vanes attached to the stator of each first fan, each set of the vanes being disposed between the tandem first and second fans wherein an orientation of a curved surface of each vane is opposite to that of the blade of each first fan so that air is sucked into the opening prior to leaving the opposite opening by passing through the first fans for bringing air to the vanes for guiding into the blades of the second fans.

2. The fan assembly of claim 1, wherein the first distance is measured at a critical point for rendering a smallest pressure drop of air circulating in the fan assembly.

3. The fan assembly of claim 1, wherein the second distance is measured at a critical point for rendering a smallest pressure drop of air circulating in the fan assembly.

* * * * *